US007461617B2

(12) United States Patent
Onodera et al.

(10) Patent No.: US 7,461,617 B2
(45) Date of Patent: Dec. 9, 2008

(54) ENGINE-DRIVEN WORK MACHINE

(75) Inventors: Taiyo Onodera, Saitama (JP); Hitoshi Yuki, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 37 days.

(21) Appl. No.: 11/667,165

(22) PCT Filed: Jan. 13, 2006

(86) PCT No.: PCT/JP2006/300347

§ 371 (c)(1),
(2), (4) Date: May 7, 2007

(87) PCT Pub. No.: WO2006/077774

PCT Pub. Date: Jul. 27, 2006

(65) Prior Publication Data

US 2008/0127912 A1 Jun. 5, 2008

(30) Foreign Application Priority Data

Jan. 20, 2005 (JP) ..... 2005-013322

(51) Int. Cl.
*F02B 63/00* (2006.01)
*F01P 7/02* (2006.01)
*F01P 1/06* (2006.01)

(52) U.S. Cl. ..... 123/2; 123/41.58; 123/41.7

(58) Field of Classification Search ..... 123/2, 123/41.11, 41.13, 41.31, 41.56, 41.58, 41.59, 123/41.62, 41.63, 41.65, 41.7, 198 D, 198 F; 290/1 A, 1 B See application file for complete search history.

(56) References Cited

U.S. PATENT DOCUMENTS

| | | | | |
|---|---|---|---|---|
| 5,121,715 | A * | 6/1992 | Nogami et al. | 123/41.7 |
| 5,908,011 | A * | 6/1999 | Stauffer et al. | 123/2 |
| 6,917,121 | B2 * | 7/2005 | Akimoto et al. | 290/1 A |
| 7,392,770 | B2 * | 7/2008 | Xiao | 123/41.7 |
| 7,398,747 | B2 * | 7/2008 | Onodera et al. | 123/41.65 |

FOREIGN PATENT DOCUMENTS

| | | |
|---|---|---|
| JP | 56-8817 | 6/1979 |
| JP | 56-79632 | 11/1979 |
| JP | 2-32836 Y2 | 9/1990 |
| JP | 3018095 U | 8/1995 |
| JP | 2539769 B2 | 7/1996 |
| JP | 9-151742 A | 6/1997 |

* cited by examiner

*Primary Examiner*—Hai H Huynh
(74) *Attorney, Agent, or Firm*—Arent Fox LLP

(57) ABSTRACT

An engine-driven work machine is provided in which an engine/work machine unit (5) and an exhaust muffler (23) are housed in a box (30), the box (30) is provided with a cooling air passage (44) that passes the area around the engine/work machine unit (5) and the exhaust muffler (23), and a cooling fan (15) driven by the engine (2) is disposed in the cooling air passage (44), wherein the box (30) is provided with blocking means (51) for blocking the cooling air passage (44) between the engine (2) and the exhaust muffler (23) when running of the engine (2) is stopped. The heat of the high temperature exhaust muffler can thus be prevented from affecting the engine/work machine unit even when running of the engine is stopped, while maintaining the soundproofing of the box housing the unit, etc.

6 Claims, 6 Drawing Sheets

ENGINE-DRIVEN WORK MACHINE

CROSS-REFERENCE TO RELATED APPLICATION

This application is [a National Stage entry of International Application No. PCT/JP2006/300347, filed Jan. 13, 2006, the entire specification claims and drawings of which are incorporated herewith by reference.

TECHNICAL FIELD

The present invention relates to an improvement of an engine-driven work machine in which an engine/work machine unit is formed by joining an engine and a work machine driven by a crankshaft of the engine, the engine/work machine unit and an exhaust muffler joined to the engine are housed in a box, the box is provided with a cooling air passage that reaches an air outlet opening on an outer face of the box from an air inlet opening on the outer face of the box while passing sequentially via the area around the engine/work machine unit and the area around the exhaust muffler, and a cooling fan is provided for generating a flow of air in the cooling air passage when the engine is running.

BACKGROUND ART

Such engine-driven work machines are widely known as engine-driven generators used as a power source for construction work, a power source for outdoor recreation, a power source for emergency use, etc.

Furthermore, the arrangement of such an engine-driven work machine is already known as disclosed in Patent Publications 1 and 2, in which from the viewpoint of consideration to the surrounding environment when it is run, particularly when running at night in an urban area, in order to suppress running noise as much as possible the engine/work machine unit and the exhaust muffler are housed in a box, this box is provided with an air inlet and an air outlet opening on an outer face of the box and with a cooling air passage that reaches the air outlet from the air inlet while passing sequentially via the area around the engine/work machine unit and the area around the exhaust muffler, and a cooling fan is provided for generating a flow of air from the air inlet side to the air outlet side in the cooling air passage. Patent Publication 1: Japanese Utility Model Registration Publication No. 2-32836 Patent Publication 2: Japanese Patent No. 2539769

DISCLOSURE OF INVENTION

Problems to be Solved by the Invention

In an arrangement in which the engine/work machine unit and the exhaust muffler are housed in a box and this box is provided with a cooling air passage that reaches an air inlet from an air inlet while passing sequentially via the area around the engine/work machine unit and the area around the exhaust muffler, when the engine is running the engine/work machine unit and the exhaust muffler can be cooled by means of cooling air passing through the cooling air passage, but when running of the engine is stopped, the heat of the exhaust muffler, which becomes particularly hot, is retained within the box, thus easily affecting the engine, etc. adjacent to the exhaust muffler, and it is therefore necessary to give consideration to improving natural ventilation, such as making the air outlet of the cooling air passage larger and making it open upward. However, if the air outlet of the cooling air passage is made larger and made to open upward, not only is the soundproofing of the box degraded, but it is also necessary to take measures against rain, etc. entering, thereby making the structure complex. Ultimately, it is not easy to achieve a balance between soundproofing and natural ventilation.

The present invention has been accomplished under the above-mentioned circumstances, and it is an object thereof to provide an engine-driven generator that prevents the heat of the high temperature exhaust muffler from affecting the engine/work machine unit even when running of the engine is stopped, while maintaining the soundproofing of the box.

Means for Solving the Problems

In order to attain the above object, according to a first aspect of the present invention, there is provided an engine-driven work machine in which an engine/work machine unit is formed by joining an engine and a work machine driven by a crankshaft of the engine, the engine/work machine unit and an exhaust muffler joined to the engine are housed in a box, the box is provided with a cooling air passage that reaches an air outlet opening on an outer face of the box from an air inlet opening on the outer face of the box while passing sequentially via the area around the engine/work machine unit and the area around the exhaust muffler, and a cooling fan is provided for generating a flow of air in the cooling air passage when the engine is running, characterized in that the box is provided with blocking means for blocking the cooling air passage between the engine and the exhaust muffler when running of the engine is stopped.

The work machine corresponds to a generator 4 of an embodiment of the present invention, which will be described later, the dividing wall corresponds to a third dividing wall 38 of the embodiment, and the air inlet and the air outlet correspond to an air inlet louver 39 and an air outlet louver 40 respectively of the embodiment.

Further, according to a second aspect of the present invention, in addition to the first aspect, the box is equipped with a dividing wall for compartmentalizing the interior thereof into a unit chamber housing the engine/work machine unit and a muffler chamber housing the exhaust muffler, and the dividing wall is provided with a communicating opening, which becomes part of the cooling air passage, and the blocking means, which can block the communicating opening.

Moreover, according to a third aspect of the present invention, in addition to the second aspect, the muffler chamber has an air outlet opening on a bottom wall.

Further, according to a fourth aspect of the present invention, in addition to the second or third aspect, the muffler chamber has a heat-insulating layer formed on an inner face from a heat-insulating material, and an inner face of the heat-insulating layer is covered with a thermally conductive body.

Furthermore, according to a fifth aspect of the present invention, in addition to any one of the first to fourth aspects, the blocking means is arranged so that it attains an open state when an intake negative pressure of the engine is generated and attains a blocking state when the intake negative pressure disappears.

EFFECTS OF THE INVENTION

In accordance with the first aspect of the present invention, since, when the engine is running, the blocking means is opened and the cooling air passage is put into a communicating state, air flows through the cooling air passage from the air inlet toward the air outlet due to the operation of the cooling fan, thus cooling the engine/work machine unit and the exhaust muffler. Furthermore, since, when running of the engine is stopped, the cooling air passage between the engine and the exhaust muffler is blocked by the blocking means, the exhaust muffler, which has a high temperature, is allowed to cool gradually, and this can prevent the heat of the high temperature exhaust muffler from affecting the engine/work machine unit. Therefore, since it is unnecessary to make the air outlet of the cooling air passage large and to make it open upward, the soundproofing of the box can be maintained.

Furthermore, in accordance with the second aspect of the present invention, due to the simple structure in which the box is equipped with the dividing wall for compartmentalizing the interior thereof into the unit chamber housing the engine/work machine unit and the muffler chamber housing the exhaust muffler, and this dividing wall is provided with the communicating opening, which forms part of the cooling air passage, and with the blocking means that can block the communicating opening, when running of the engine is stopped, communication between the unit chamber and the muffler chamber can be blocked, thus preventing the heat of the exhaust muffler from affecting the engine/work machine unit.

Moreover, in accordance with the third aspect of the present invention, due to the structure in which the air outlet opens on the bottom wall of the muffler chamber, it is possible to reliably prevent rain, etc. from entering the air outlet. It is therefore unnecessary to take special measures against rain, etc. entering the air outlet, thereby contributing to a simplification of the structure.

Furthermore, in accordance with the fourth aspect of the present invention, the thermally conductive body covering, from the inside, the heat-insulating layer on the inner face of the muffler chamber can disperse radiant heat from the exhaust muffler throughout the heat-insulating layer, thus preventing the heat-insulating layer from overheating locally, and as a result the muffler chamber can be gradually cooled effectively via the entire heat-insulating material.

Moreover, in accordance with the fifth aspect of the present invention, it is possible to automatically control the open and blocking states of the blocking means according to whether the engine is running or is stopped.

EXPLANATION OF REFERENCE NUMERALS AND SYMBOLS

Figure 1:
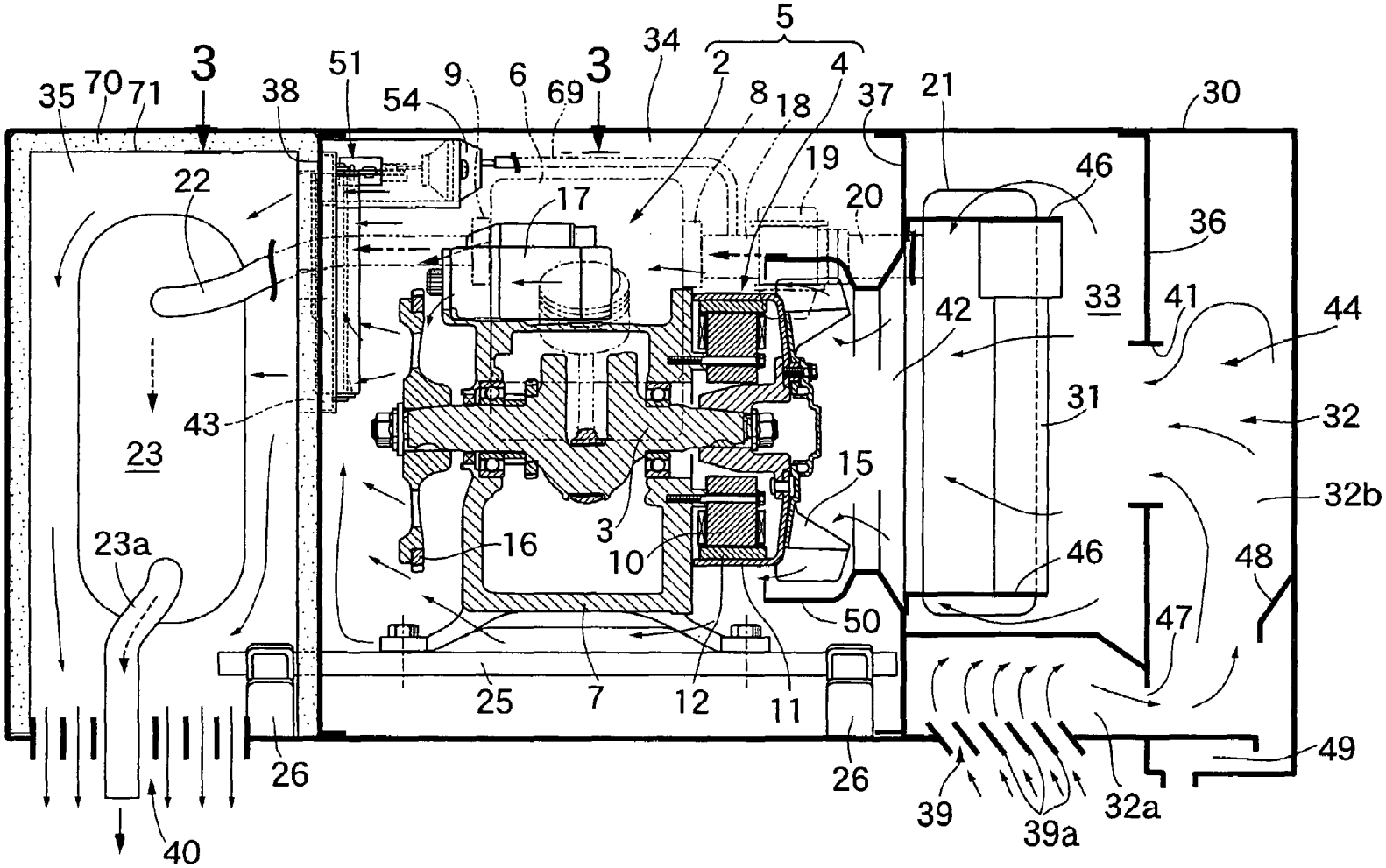
FIG. 1 is a vertical sectional front view of an engine-driven generator related to the present invention (first embodiment).

1 Engine-driven work machine (engine-driven generator)
2 Engine
3 Crankshaft
4 Generator
5 Engine/work machine unit
15 Cooling fan
23 Exhaust muffler
30 Box
34 Unit chamber
35 Muffler chamber
38 Dividing wall (third dividing wall)
39 Air inlet (air inlet louver)
40 Air outlet (air outlet louver)
43 Communicating opening (third communicating opening)
44 Cooling air passage
51 Blocking means
70 Heat-insulating layer
71 Thermally conductive body

BEST MODE FOR CARRYING OUT THE INVENTION

A mode for carrying out the present invention is explained by reference to a preferred embodiment of the present invention shown in the drawings.

EMBODIMENT 1

First, in FIG. 1, an engine-driven generator 1 as an engine-driven work machine includes an engine/work machine unit 5 formed by joining an engine 2 and a generator 4 driven by a crankshaft 3 of the engine 2. The engine 2 is a 4 cycle type, a cylinder portion 6 thereof projects obliquely upward toward one side from a crankcase 7 housing and supporting the crankshaft 3, and an intake port 8 and an exhaust port 9 open on a right-hand side face and a left-hand side face respectively of the cylinder portion 6.

The generator 4 is formed from a stator 10 fixed to a right-hand side face of the crankcase 7 and a bottomed cylindrical outer rotor 11 fixed to a right-hand end portion of the crankshaft 3 extending through a right-hand side wall of the crankcase 7, and the outer rotor 11 includes a plurality of permanent magnets 12 fixed to an inner peripheral face thereof and arranged in the peripheral direction. This generator 4 is therefore a so-called magnet outer rotor multi-pole generator. The outer rotor 23 has a centrifugal cooling fan 15 mounted on an outer end face thereof, the cooling fan 15 having a larger diameter than that of the outer rotor 23. A ring gear 16 is fixed to a left-hand end portion of the crankshaft 3, and a starter motor 17 is mounted on the crankcase 7 or the cylinder portion 6, the starter motor 17 being capable of cranking the crankshaft 3 via the ring gear 16.

A carburetor 19 is mounted on a right-hand side face of the cylinder portion 6 via an intake pipe 18 communicating with the intake port 8, and an air cleaner 21 is connected to an intake path entrance of the carburetor 19 via an intake duct 20. An exhaust muffler 23 is connected to a left-hand side face of the cylinder portion 6 via an exhaust pipe 22 communicating with the exhaust port 9.

The crankcase 7 of the engine 2 is supported on an engine bed 25, and this engine bed 25 is supported on a machine stand 26 via an elastic member, which is not illustrated. The engine 2, the generator 4, the carburetor 19, the air cleaner 21, and the exhaust muffler 23 are housed in a rectangular parallelepiped box 30, and a bottom wall of this box 30 is joined to the machine stand 26. An electrical component 31 (e.g. an inverter) for controlling the output of the generator 4 is disposed adjacent to the air cleaner 21.

The box 30 is equipped with first to third dividing walls 36 to 38, which compartmentalize the interior of the box 30 into a gas/liquid separation chamber 32 for taking in outside air and separating water droplets, etc. from the outside air, an electrical component chamber 33 having the electrical component 31 and the air cleaner 21 disposed therein, a unit chamber 34 having the engine/work machine unit 5 disposed therein, and a muffler chamber 35 having the exhaust muffler 23 disposed therein. An air inlet louver 39 is provided in a bottom wall of the gas/liquid separation chamber 32. The first dividing wall 36 is provided with a first communicating opening 41 providing communication between the gas/liquid separation chamber 32 and the electrical component chamber 33, the second dividing wall 37 is provided with a second communicating opening 42 providing communication between the electrical component chamber 33 and the unit chamber 34, and the third dividing wall 38 is provided with a third communicating opening 43 providing communication between the unit chamber 34 and the muffler chamber 35. An air outlet louver 40 is provided in a bottom wall of the muffler chamber 35, and a tail pipe 23*a* of the exhaust muffler 23 is disposed so as to run through the air outlet louver 40.

The air inlet louver 39, the gas/liquid separation chamber 32, the first communicating opening 41, the electrical component chamber 33, the second communicating opening 42, the unit chamber 34, the third communicating opening 43, the muffler chamber 35, and the air outlet louver 40 thereby form a cooling air passage 44 running around the electrical component 31, the engine/work machine unit 5, and the exhaust muffler 23.

The electrical component 31 is supported by a pair of upper and lower stays 46 and 46 which are made to project from the second dividing wall 37 toward the electrical component chamber 33 side. In this arrangement, the electrical component 31 is disposed with a fixed spacing from the first dividing wall 36 so as not to block the first communicating opening 41. The intake duct 20, which provides communication between the air cleaner 21 and the carburetor 19, runs through the first dividing wall 36.

Figure 2:
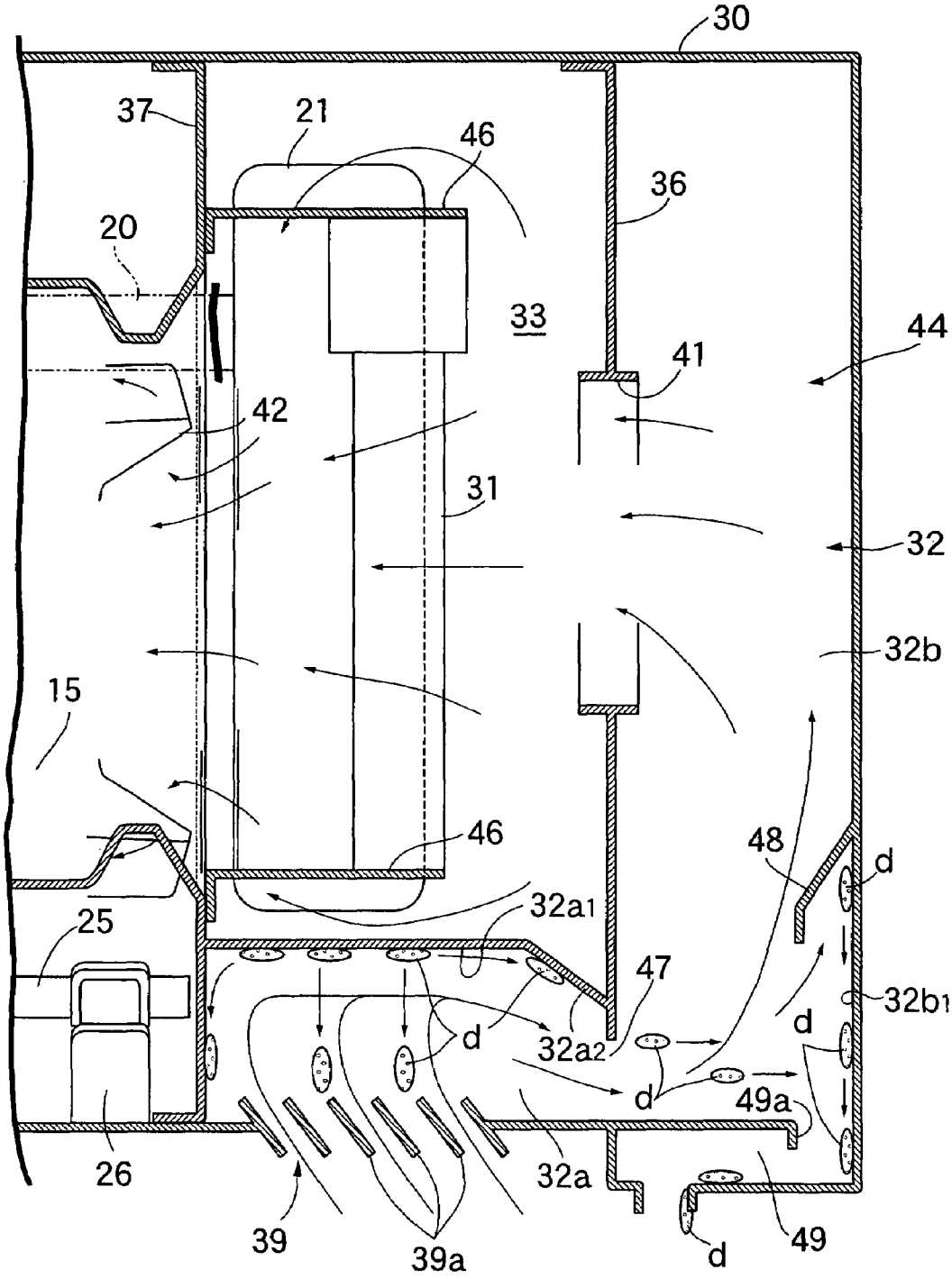
FIG. 2 is an enlarged view of the area around a cooling air intake opening in FIG. 1 (first embodiment).

As is clearly shown in FIG. 2, the gas/liquid separation chamber 32 is formed from a horizontal chamber 32*a*, which has the air inlet louver 39 in its bottom wall and extends horizontally, and a vertical chamber 32*b*, which rises from a right-hand end part of the horizontal chamber 32*a*, and the horizontal chamber 32*a* and vertical chamber 32*b* communicate via a constricted opening 47. The vertical chamber 32*b* communicates with the electrical component chamber 33 via the first communicating opening 41.

The air inlet louver 39, which is provided in the bottom wall of the horizontal chamber 32*a*, includes a plurality of guide blades 39*a* for directing air that is taken into the horizontal chamber 32*a* in a direction opposite to that of the vertical chamber 32*b*. A horizontal wall face 32*a*1 on the ceiling side of the horizontal chamber 32*a* is formed relatively low so that air that has passed through the air inlet louver 39 collides with the horizontal wall face 32*a*1, and an end portion of the horizontal wall face 32*a*1 that is adjacent to the constricted opening 47 is formed as an inclined wall face 32*a*2, which is inclined toward the constricted opening 47.

Furthermore, a vertical wall face 32*b*1 of the vertical chamber 32*b* that faces the constricted opening 47 is disposed relatively close to the constricted opening 47 so that air that has passed through the constricted opening 47 collides with the vertical wall face 32*b*1, and the vertical wall face 32*b*1 is equipped with a water droplet trap 48, which projects in a canopy shape in a middle section between the constricted opening 47 and the first communicating opening 41. A drain hole 49 is formed in the bottom wall of the vertical chamber 32*b*, the drain hole 49 bending in a labyrinth shape and opening on the lower face of the box 30 and, in particular, an opening 49*a* of this drain hole 49 to the vertical chamber 32*b* is disposed directly below the water droplet trap 48.

Referring again to FIG. 1, the second dividing wall 37 has a fan cover 50 provided so as to be connected thereto, the fan cover 50 extending from the peripheral edge of the second communicating opening 42 and covering the outer periphery of the cooling fan 15, and the cooling fan 15 guiding to the outer periphery of the engine/work machine unit 5 air that has been taken in via the first communicating opening 41.

Figure 3:
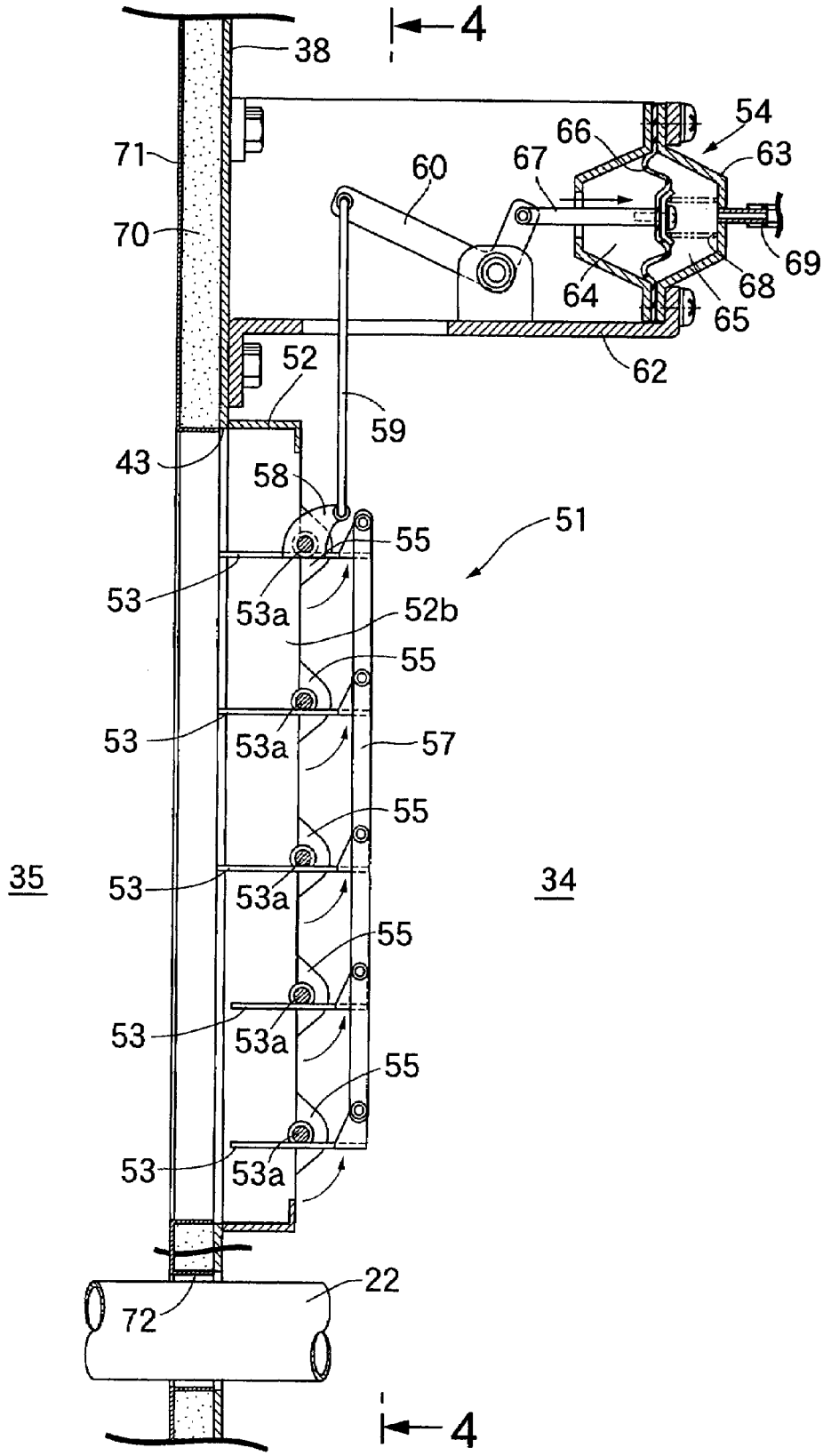
FIG. 3 is an enlarged sectional view along line 3-3 in FIG. 1 (showing blocking means in an open state) (first embodiment).
Figure 4:
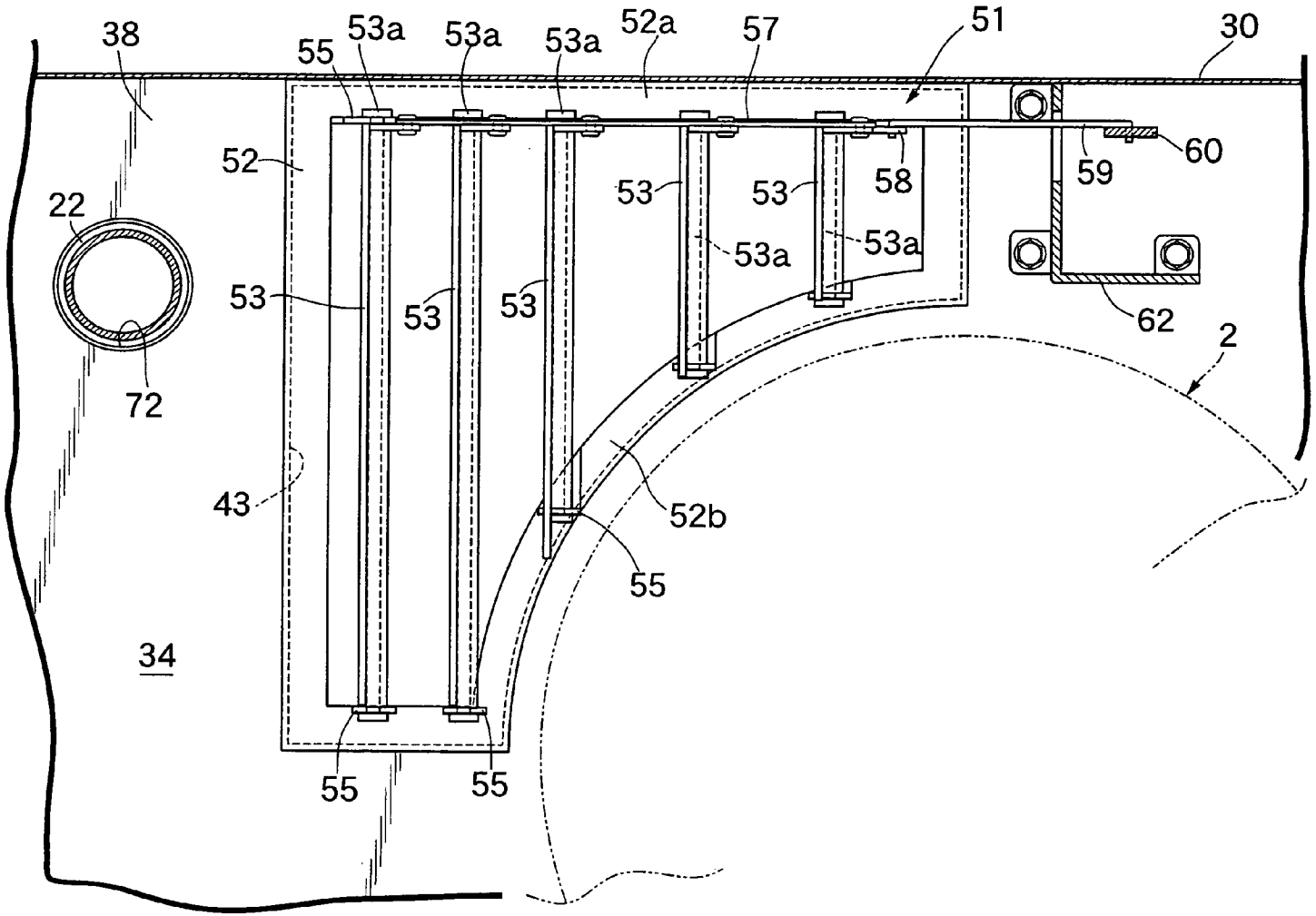
FIG. 4 is a sectional view along line 4-4 in FIG. 3 (first embodiment).

In FIG. 1, FIG. 3, and FIG. 4, the third dividing wall 38 is provided with blocking means 51 for closing the third communicating opening 43. This blocking means 51 is formed from a frame body 52 mounted on the third dividing wall 38 so as to surround the third communicating opening 43 on the unit chamber 34 side, a plurality of valve plates 53 axially supported on the frame body 52 so as to open and close, and an actuator 54 disposed in the unit chamber 34 so as to make the valve plates 53 open and close. Each of the valve plates 53 includes a valve shaft 63*a* rotatably supported by a pair of upper and lower brackets 55 and 55 formed on an upper frame 52*a* and a lower frame 52*b* of the frame body 52, and all the valve plates 53 are connected to one common synchronous link 57 for synchronizing opening and closing operations.

Among the plurality of valve plates 53, the outermost valve plate 53 has an operating arm 58 formed on one end part, and the actuator 54 is coupled to this operating arm 58 via a link 59 and a bellcrank 60.

The actuator 54 is formed from a shell 63 fixedly supported by a stay 62 secured to the third dividing wall 38 in the unit chamber 34, a diaphragm 66 that compartmentalizes the interior of the shell 63 into an atmospheric chamber 64 on the bellcrank 60 side and a negative pressure operating chamber 65 on the opposite side, an operating rod 67 connected to a central part of the diaphragm 66, running through the atmospheric chamber 64, and projecting outside the shell 63, and a return spring 68 housed in the negative pressure operating chamber 65 and urging the diaphragm 66 toward the atmospheric chamber 64 side. The atmospheric chamber 64 is open to the atmosphere, the negative pressure operating chamber 65 communicates with the interior of the intake pipe 18 via a negative pressure guide tube 69, and while the engine 2 is running intake negative pressure is introduced into the negative pressure operating chamber 65.

The bellcrank 60 is axially supported by the stay 62, has the operating rod 67 connected to one end, and has the other end connected to the operating arm 58 via the link 59.

Figure 5:
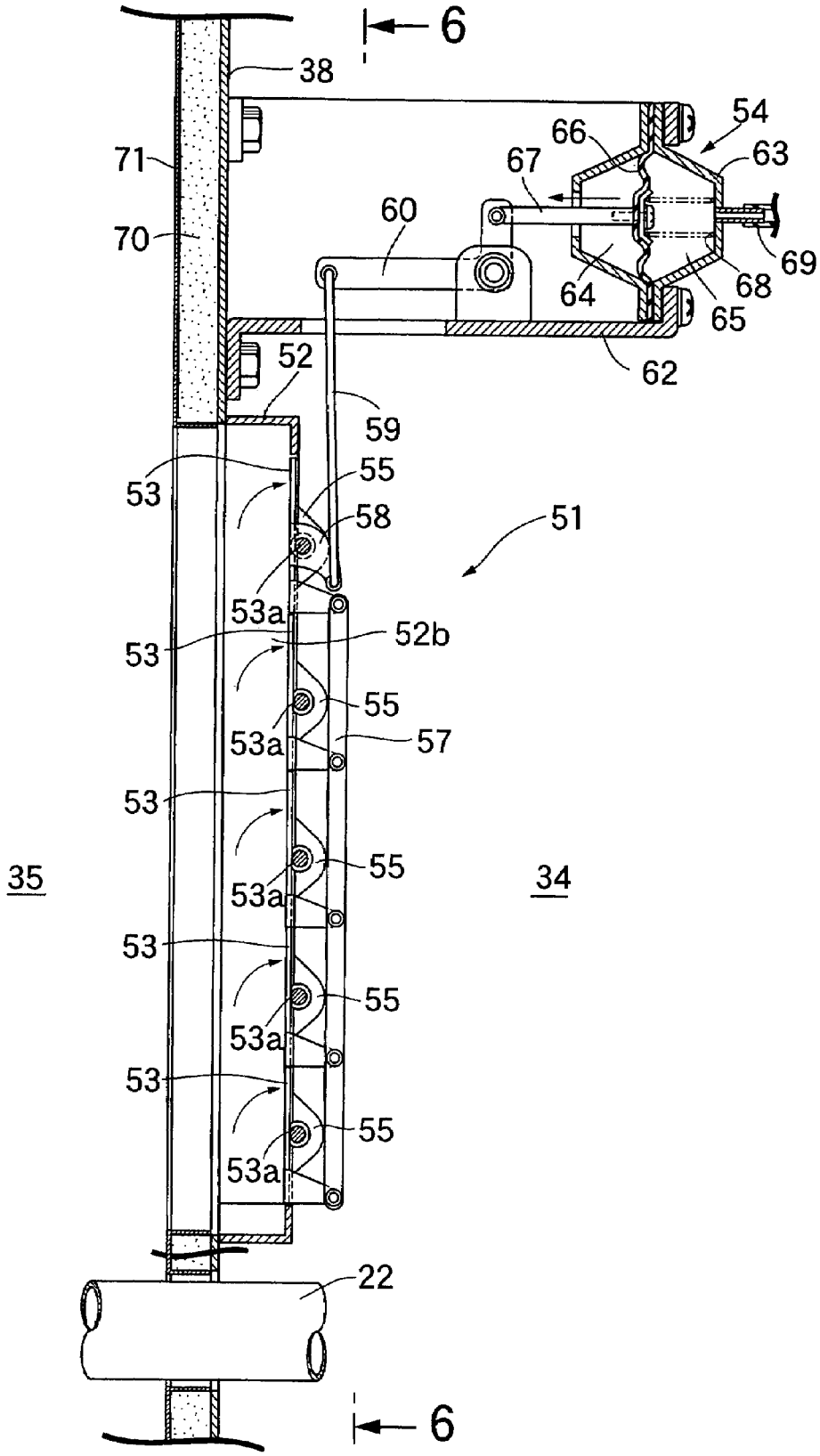
FIG. 5 is a view, corresponding to FIG. 3, showing the blocking means in a blocking state (first embodiment).

While the engine 2 is running, when the intake negative pressure generated within the intake pipe 18 is introduced into the negative pressure operating chamber 65, the negative pressure acts so as to displace the diaphragm 66 toward the negative pressure operating chamber 65 side and pull the operating rod 67, this pulling force is transmitted to the operating arm 58 via the bellcrank 60 and the link 59, and by pivoting the operating arm 58 in an anticlockwise direction as shown in FIG. 3 all the valve plates 53 open simultaneously. When running of the engine 2 is stopped, the intake negative pressure disappears from the intake pipe 18 and the intake path of the carburetor 19; since the negative pressure of the negative pressure operating chamber 65 is also lost, the diaphragm 66 therefore pushes out the operating rod 67 by means of the urging force of the return spring 68, this pushing force is transmitted to the operating arm 58 via the bellcrank 60 and the link 59, and by pivoting the operating arm 58 in a clockwise direction as shown in FIG. 5 all the valve plates 53 are closed simultaneously.

As shown in FIG. 1 and FIG. 3, a heat-insulating layer 70 made of a heat-insulating material such as glass wool is bonded to the entire inner face of the muffler chamber 35, and the entire inner face of the heat-insulating layer 70 is covered with a thermally conductive body 71 made of aluminum foil, etc.

The exhaust pipe 22 is arranged so as to run through a series of through holes 72 provided in the third dividing wall 38, the heat-insulating layer 70, and the thermally conductive body 71.

The operation of this embodiment is now explained.

When the engine 2 is run, air that has been filtered by the air cleaner 21 within the electrical component chamber 33 and that is accompanied by fuel in the carburetor 19 is taken into the engine 2 through the intake pipe 18. The intake negative pressure generated within the intake pipe 18 due to the above intake action of the engine 2 is transmitted to the negative pressure operating chamber 65 of the actuator 54 via the negative pressure guide tube 69, and the diaphragm 66 pulls the operating rod 67 as described above to thus open all the valve plates 53 simultaneously and thereby open the third communicating opening 43 (see FIG. 3 and FIG. 4). The cooling air passage 44 from the air inlet louver 39 to the air outlet louver 40 therefore attains an open state.

Since the crankshaft 3 of the engine 2 rotates the outer rotor 11 of the generator 4 and the cooling fan 15 simultaneously, the generator 4 attains a generating state, and the power thus generated is taken out to the outside via a control panel (not illustrated). The rotating cooling fan 15 takes in outside air as cooling air from the air inlet louver 39 via the gas/liquid separation chamber 32, the first communicating opening 41, the electrical component chamber 33, and the second communicating opening 42, and as shown by arrows makes it pass in sequence through the unit chamber 34, the third communicating opening 43, and the muffler chamber 35, and makes it flow to the outside via the air outlet louver 40. In this process, in sequence, the electrical component 31 is cooled by cooling air passing through the electrical component chamber 33, the engine 2 and the generator 4 are cooled by cooling air passing through the unit chamber 34, and the exhaust muffler 23 is cooled by cooling air passing through the muffler chamber 35.

Moreover, since the engine 2, the generator 4, the cooling fan 15, the exhaust muffler 23, etc. are entirely covered by the box 30, running noise generated therefrom can be blocked effectively by the box 30, and quietness can be achieved for the engine-driven generator 1.

When it is raining or there is a dense fog, mist might be taken into the air inlet louver 39 together with the cooling air, and the mist is separated and removed from the cooling air by the gas/liquid separation chamber 32 as follows.

That is, when mist-containing cooling air first flows via the air inlet louver 39 into the horizontal chamber 32*a* of the gas/liquid separation chamber 32, since the cooling air is directed obliquely upward in a direction opposite to the vertical chamber 32*b* by means of the plurality of guide blades 39*a* of the louver 39, after colliding with the horizontal wall face 32*a*1 on the ceiling, the flow of cooling air undergoes a large change in direction so as to make a U-turn toward the vertical chamber 32*b* along the horizontal wall face 32*a*1, the mist contained in the cooling air is centrifugally separated from the cooling air due to a difference in specific gravity, becomes attached to the horizontal wall face, and falls down as water droplets d. Subsequently, horizontal flow of the cooling air along the horizontal wall face 32*a*1 is changed obliquely downward by the inclined wall face 32*a*2, and mist remaining in the cooling air turns into water droplets, which are thrown off downward and separated.

Furthermore, since, when the cooling air moves from the horizontal chamber 32*a* to the vertical chamber 32*b* via the constricted opening 47, its flow is accelerated by means of the constricted opening 47, the cooling air collides forcibly with the vertical wall face 32*b*1 of the vertical chamber 32*b*, and mist remaining in the cooling air becomes attached to the vertical wall face 32*b*1, turns into water droplets d, and falls down. Furthermore, even if water droplets d attached to the vertical wall face 32*b*1 are guided upward by the ascending cooling air, they are captured by the water droplet trap 48, are decelerated, and fall.

The water droplets d that have fallen from the vertical wall face 32*b*1 and the water droplet trap 48 quickly flow out to the outside via the drain hole 49 directly below the water droplet trap 48.

Since mist can thus be separated from cooling air efficiently and the electrical component 31, the engine 2, the generator 4, and the exhaust muffler 23 can be cooled by cooling air that contains no mist or very little mist, it is possible to prevent mist from affecting the electrical component 31, the engine 2, the generator 4, and the exhaust muffler 23, and it is also possible for the engine 2 to take in through the air cleaner 21 air that contains no mist or very little mist. Furthermore, since both the air inlet louver 39 and the air outlet louver 40 are mounted on the bottom wall of the box 30, it is possible to easily prevent rain from entering these louvers 39 and 40.

Figure 6:
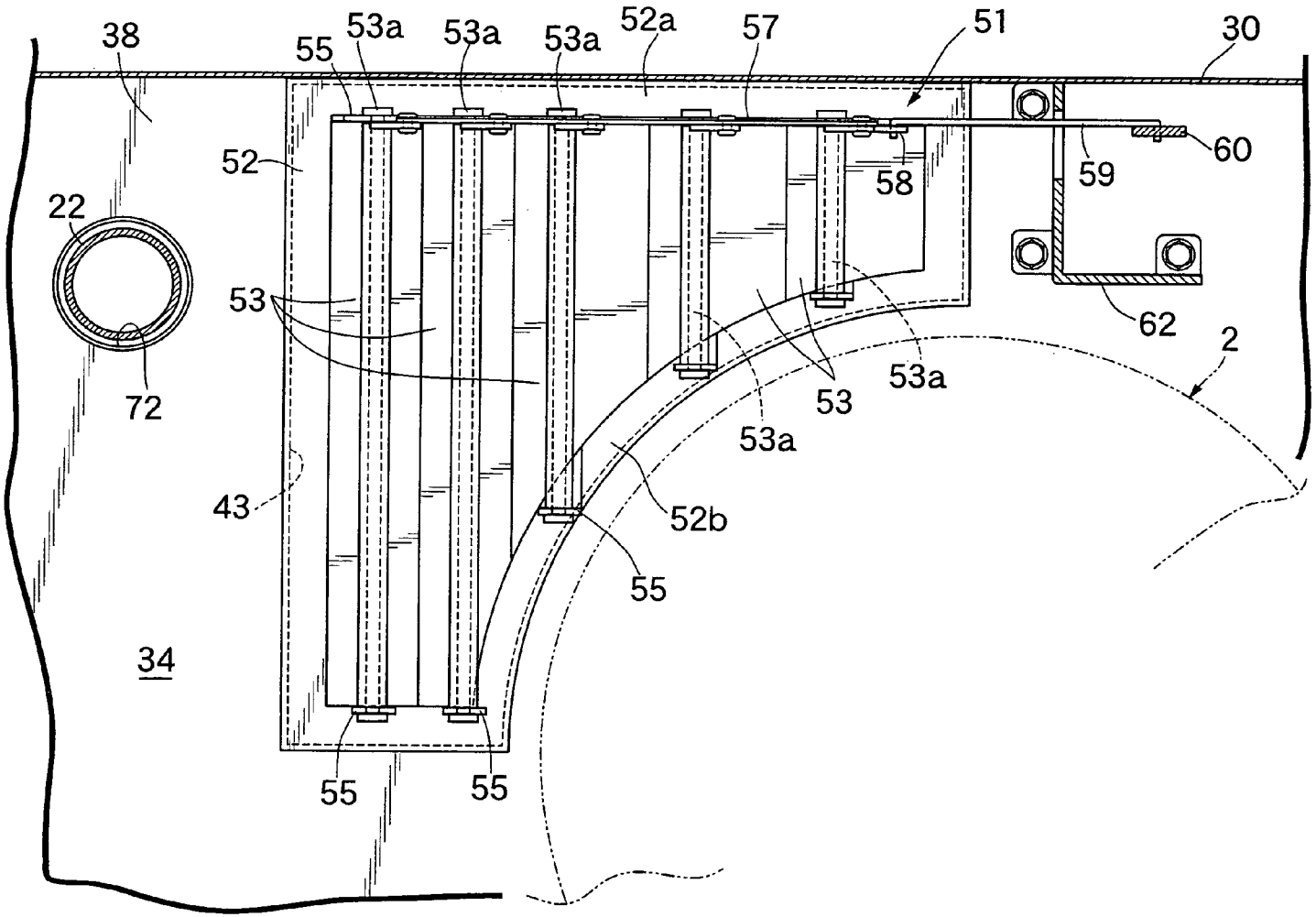
FIG. 6 is a sectional view along line 6-6 in FIG. 5 (first embodiment).

When running of the engine 2 is stopped, the intake negative pressure within the intake pipe 18 disappears, negative pressure of the negative pressure operating chamber 65 of the actuator 54 also disappears, and as described above the diaphragm 66 pushes out the operating rod 67 by means of the urging force of the return spring 68 so as to close all the valve plates 53 simultaneously, thus closing the third communicating opening 43 (see FIG. 5 and FIG. 6). This allows communication between the unit chamber 34 and the muffler chamber 35 to be blocked. By allowing the high temperature exhaust muffler 23 to stand and gradually cool in the muffler chamber 35 the heat of the exhaust muffler 23 can be prevented from affecting the engine/work machine unit 5 or the outer face of the box 30 and, moreover, since it is unnecessary for the air outlet to be large or to open upward, it is possible to ensure that the box 30 is soundproof.

In particular, since the heat-insulating layer 70, which is made of a heat-insulating material such as glass wool, is bonded to the entire inner face of the muffler chamber 35, and the entire inner face of the heat-insulating layer 70 is covered with the thermally conductive body 71, which is made of aluminum foil, etc., radiant heat that the thermally conductive body 71 receives from the exhaust muffler 23 is dispersed throughout the heat-insulating layer 70, thus preventing the heat-insulating layer 70 from being locally overheated, and the entire heat-insulating layer 70 cools gradually, thus promoting equal and gradual cooling of the entire muffler chamber 35, and thereby reliably preventing heat of the exhaust muffler 23 from affecting the engine/work machine unit 5 or the outer face of the box 30.

Furthermore, since the valve plates 53 are opened and closed by putting the actuator 54 in an operative or inoperative state according to the presence or absence of intake negative pressure of the engine 2, it is possible to automatically control the open and closed states of the valve plates 53 according to whether the engine 2 is running or is stopped.

The present invention is not limited to the above-mentioned embodiment, and may be modified in a variety of ways as long as the modifications do not depart from the spirit and scope thereof. For example, the actuator 54 may be formed as an electromagnetic type in which its operation is controlled by a switch that detects the presence or absence of intake negative pressure of the engine 2.

The invention claimed is:

1. An engine-driven work machine in which an engine/work machine unit (5) is formed by joining an engine (2) and a work machine (4) driven by a crankshaft (3) of the engine (2), the engine/work machine unit (5) and an exhaust muffler (23) joined to the engine (2) are housed in a box (30), the box (30) is provided with a cooling air passage (44) that reaches an air outlet (40) opening on an outer face of the box (30) from an air inlet (39) opening on the outer face of the box (30) while passing sequentially via the area around the engine/work machine unit (5) and the area around the exhaust muffler (23), and a cooling fan (15) is provided for generating a flow of air in the cooling air passage (44) when the engine (2) is running, characterized in that the box (30) is provided with blocking means (51) for blocking the cooling air passage (44) between the engine (2) and the exhaust muffler (23) when running of the engine (2) is stopped.

2. The engine-driven work machine according to claim 1, wherein the box (30) is equipped with a dividing wall (38) for compartmentalizing the interior thereof into a unit chamber housing the engine/work machine unit (5) and a muffler chamber (35) housing the exhaust muffler (23), and the dividing wall (38) is provided with a communicating opening (43), which becomes part of the cooling air passage (44), and the blocking means (51), which can block the communicating opening (43).

3. The engine-driven work machine according to claim 2, wherein the muffler chamber (35) has an air outlet (40) opening on a bottom wall.

4. The engine-driven work machine according to claim 2 or 3, wherein the muffler chamber (35) has a heat-insulating layer (70) formed on an inner face from a heat-insulating material, and an inner face of the heat-insulating layer (70) is covered with a thermally conductive body (71).

5. The engine-driven work machine according to claim 4, wherein the blocking means (51) is arranged so as to attain an open state when an intake negative pressure of the engine (2) is generated and to attain a blocking state when the intake negative pressure disappears.

6. The engine-driven work machine according to any one of claims 1, 2, or 3 wherein the blocking means (51) is arranged so as to attain an open state when an intake negative pressure of the engine (2) is generated and to attain a blocking state when the intake negative pressure disappears.

* * * * *